US008593481B2

(12) United States Patent
Morgenbrod

(10) Patent No.: US 8,593,481 B2
(45) Date of Patent: Nov. 26, 2013

(54) METHOD AND ARRANGEMENT FOR SETTING A COLOR LOCUS, AND LUMINOUS SYSTEM

(75) Inventor: Nico Morgenbrod, Martinroda (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 661 days.

(21) Appl. No.: 12/746,527

(22) PCT Filed: Dec. 5, 2008

(86) PCT No.: PCT/EP2008/010343

§ 371 (c)(1),
(2), (4) Date: Jun. 7, 2010

(87) PCT Pub. No.: WO2009/071314

PCT Pub. Date: Jun. 11, 2009

(65) Prior Publication Data

US 2010/0259198 A1 Oct. 14, 2010

(30) Foreign Application Priority Data

Dec. 7, 2007 (DE) ..... 10 2007 059 130

(51) Int. Cl.
*G09G 5/02* (2006.01)

(52) U.S. Cl.
USPC ..... 345/597; 345/589; 345/590; 345/211

(58) Field of Classification Search
USPC ..... 315/185 S, 224, 225, 291, 307–326; 345/102, 78, 82, 204, 211–214, 597, 345/591, 589, 590
See application file for complete search history.

(56) References Cited

U.S. PATENT DOCUMENTS

| | | | | |
|---|---|---|---|---|
| 5,384,519 | A | 1/1995 | Gotoh | |
| 6,411,046 | B1 * | 6/2002 | Muthu | 315/309 |
| 7,009,343 | B2 | 3/2006 | Lim et al. | |
| 7,626,346 | B2 * | 12/2009 | Scilla | 315/309 |
| 8,330,383 | B2 * | 12/2012 | Man et al. | 315/247 |
| 2006/0193133 | A1 | 8/2006 | Von Der Brelle | |
| 2006/0245174 | A1 | 11/2006 | Ashdown et al. | |
| 2007/0081357 | A1 | 4/2007 | Kim et al. | |
| 2008/0079371 | A1 * | 4/2008 | Kang et al. | 315/309 |
| 2008/0215279 | A1 * | 9/2008 | Salsbury et al. | 702/107 |
| 2008/0224634 | A1 * | 9/2008 | Scilia | 315/294 |

FOREIGN PATENT DOCUMENTS

| | | | |
|---|---|---|---|
| CN | 1949037 | A | 4/2007 |
| DE | 4341669 | A1 | 6/1994 |
| DE | 10040155 | A1 | 3/2002 |
| DE | 102005001685 | A1 | 9/2005 |
| DE | 202006019332 | U1 | 3/2007 |
| DE | 102006009551 | A1 | 9/2007 |
| DE | 102006010999 | A1 | 9/2007 |

(Continued)

OTHER PUBLICATIONS

International Search Report of International application No. PCT/EP2008/010343 mailed Nov. 18, 2009.

(Continued)

*Primary Examiner* — Tuyet Thi Vo

(57) ABSTRACT

A method for setting a color locus of at least one luminous source is provided. The method may include determining a temperature, and setting the color locus of the at least one luminous source depending on the temperature determined.

14 Claims, 5 Drawing Sheets

(56) References Cited

FOREIGN PATENT DOCUMENTS

| | | | |
|---|---|---|---|
| WO | 0247438 | A2 | 6/2002 |
| WO | 2006011108 | A1 | 2/2006 |
| WO | 2006105649 | A1 | 10/2006 |
| WO | 2006109237 | A1 | 10/2006 |
| WO | 2006126124 | A2 | 11/2006 |
| WO | 2007019663 | A1 | 2/2007 |
| WO | 2007090283 | A1 | 8/2007 |
| WO | 2009034060 | A1 | 3/2009 |

OTHER PUBLICATIONS

English language abstract of DE 100 40 155 A1.
English language abstract of DE 20 2006 019 332 U1.
English language abstract of DE 10 2006 009 551 A1.
English language machine translation of DE 10 2006 010 999 A1.
International Preliminary Report on Patentability mailed on Jul. 6, 2010.

* cited by examiner

METHOD AND ARRANGEMENT FOR SETTING A COLOR LOCUS, AND LUMINOUS SYSTEM

RELATED APPLICATIONS

The present application is a national stage entry according to 35 U.S.C. §371 of PCT application No.: PCT/EP2008/010343 filed on Dec. 5, 2008, which claims priority from German application No.: 10 2007 059 130.8 filed on Dec. 7, 2007.

TECHNICAL FIELD

Various embodiments relate to a method and an arrangement for setting a color locus, and a luminous system.

BACKGROUND

Three colors are required for setting and stabilizing a color locus. Each of these individual colors is described by three color valences XYZ. The mixture of three colors is uniquely determined by an equation system having three equations and three unknowns.

For applications appertaining to lighting technology, luminous systems based on three individual colors are unsatisfactory with regard to their luminous characteristic; in particular, such a luminous characteristic is perceived as unpleasant by an observer.

Therefore, more than three individual colors can be used in luminous systems. In the case of a mixture of more than three individual colors for a color locus, an overdetermined equation system arises.

Various light means, in particular light emitting diodes and/or combinations of light emitting diodes having different wavelengths, are used as luminous sources in a luminous system.

Temperature effects influence the color locus of luminous sources, in particular of LEDs. Accordingly, it is necessary, particularly with regard to a constant overall impression of the luminous sources, to set or adjust the color locus iteratively or continuously.

For this purpose, use is made of optical sensors which monitor at least one of the luminous sources and can therefore ascertain a deviation of the instantaneous color locus of the luminous sources from a predefined desired color locus.

In this case, it is disadvantageous that an optical sensor is complex and in particular expensive.

SUMMARY

Various embodiments avoid the disadvantages mentioned above and, for example specify a possibility for particularly efficiently setting a color locus of a luminous system or luminous module including at least one luminous source, which, by way of example, can manage without optical sensors for detecting the present color locus.

In various embodiments, a method for setting a color locus, e.g. a desired color locus, of at least one luminous source, e.g. of at least one LED is specified, wherein a temperature is determined, and wherein the color locus of the at least one luminous source is set depending on the temperature determined.

Consequently, the color locus of the at least one luminous source can be set depending on the temperature. In particular, the temperature can be a temperature of the at least one luminous source or a temperature of a luminous module, the at least one luminous source preferably being arranged on the luminous module.

It is possible to achieve the setting and/or iterative or continuous regulation of the color locus of the at least one luminous source without using expensive optical sensors separately for this purpose.

In one development, the color locus of the luminous source comprises a brightness and/or a color saturation.

In another development, the color locus corresponds to a desired color locus, which is predefined, in particular.

Consequently, the color locus can be predefined e.g. by a user of the luminous module, which can be arranged in a lamp or luminaire, in accordance with the individual requirements (e.g. hue and brightness). In the context of the setting presented here, this color locus is then kept substantially constant (or deviations e.g. on account of thermal effects are at least substantially compensated for).

In one development, moreover, the temperature of the at least one luminous source is determined.

In one development, in particular, the at least one luminous source is arranged on a luminous module and the temperature of the at least one luminous source and/or of the luminous module is determined.

Consequently, it is possible to determine the temperature of the at least one luminous source, in particular of each luminous source which is provided on a luminous module. Moreover, in addition or as an alternative to this, for example, the temperature of the luminous module can be determined, the at least one luminous source preferably being thermally coupled to the luminous module.

The temperature of the at least one luminous source and/or the temperature of the luminous module can include, in particular, at least one temperature ("junction temperature") of an LED p-n junction, as a result of which properties (e.g. brightness and wavelength) of the respective luminous source are determined.

In particular, depending on an electrical power consumed by a luminous source, an efficiency, a brightness (set by means of a pulse width modulation) and also a current and a voltage, the electrical power required by the at least one luminous source can be determined. Furthermore, on the basis of this electrical power per luminous source, the respective temperature thereof can be determined by means of at least one measured temperature of a temperature sensor and also a thermal resistance of the arrangement including the at least one luminous source being taken into account.

In one development, moreover, the temperature is determined on the basis of at least one temperature sensor, in particular on the basis of an NTC thermistor and/or a PTC thermistor.

In one development, furthermore, a plurality of temperature sensors are provided at different locations.

In particular, a plurality of temperature sensors can be provided at different locations of the luminous module on which the at least one luminous source is arranged.

In the context of an additional development, the temperature is furthermore determined on the basis of an emitted power and/or on the basis of a thermal resistance.

A next development consists in the fact that a brightness and a wavelength of the at least one luminous source are determined on the basis of the temperature of the at least one luminous source. In particular, the brightnesses and the wavelengths of each luminous source of the luminous module can be determined.

In one configuration, the brightness and the wavelength are determined depending on predefined calibration data.

By way of example, calibration data are provided which correspond to a comparison value for the brightness and the dominant wavelength of the luminous source at a specific temperature. In this case, preferably the real luminous sources, in particular the real LEDs are taken into account in order to be able to compensate for possible production tolerances at least proportionately.

An alternative embodiment consists in the fact that the brightness and the wavelength are determined depending on ageing information concerning the at least one luminous source. Preferably, the ageing information can be an ageing characteristic curve of the luminous source.

In a next configuration, the brightness and the wavelength of the at least one luminous source are converted into an actual color locus. Accordingly, the actual color locus can be compared with the color locus and the at least one luminous source can be driven in such a way that the (desired) color locus is attained.

Consequently, it is successfully possible for fluctuations of the at least one luminous source and/or of the luminous module including the at least one luminous source to be compensated for at least proportionately, in particular substantially completely.

In one configuration, moreover, the at least one luminous source is set iteratively in such a way that the color locus is attained.

This iteration can include a regulation initiated at predefined points in time. It is also possible for the regulation to be effected substantially continuously.

One development consists in the fact that a plurality of luminous sources are provided in such a way that the plurality of luminous sources or some of the plurality of luminous sources have only small to no overlaps in the respective spectra thereof.

In an additional configuration, the luminous source includes at least one luminous means, in particular at least one LED.

In this case, it should be noted that each luminous source can include a plurality of luminous means, e.g. LEDs. Advantageously, each luminous source can include a plurality of LEDs each having substantially the same wavelength. It is also possible for a luminous source to have a plurality of LEDs having different wavelengths.

In another configuration, a brightness of the luminous source is set by means of a pulse width modulation.

In one possibility, moreover, n luminous sources are provided, of which n−3 luminous sources are preset or have been preset. A color locus difference of the n luminous sources from a desired color locus is determined, and the 3 luminous sources that have not been preset are set in such a way that the desired color locus is attained.

The color locus is determined, in particular, in the form of coordinates of a color space. The intensities of the 3 luminous sources can be modified in such a way that a coordinate in the color space, also referred to as desired color value, is set or attained.

The presetting of the n−3 luminous sources can advantageously be performed offline by means of optical as well as physical parameters (wavelengths of the luminous sources, emission characteristics, physical design) and also the luminous system (extent, distances between the luminous sources, etc.) including the luminous sources being taken into account. The over-determined equation system (3 luminous sources suffice for setting the color locus) can thereby be reduced in such a way that a desired color locus can be efficiently set by means of the remaining 3 luminous sources.

In one development, in particular, the color locus is set on the basis of the n luminous sources in such a way that at least one of the target variables

- color rendering index;
- color quality scale;
- an application-dependent spectral distribution attains a predefined value as well as possible.

Accordingly, a target value optimization with regard to at least one of the target variables mentioned can be effected, this optimization expediently being carried out beforehand and being stored or saved in or for a control and/or regulating unit for setting the luminous sources.

In one development, moreover, an optimization with regard to the at least one target variable is carried out beforehand and, in particular, is provided as driving information for the 3 luminous sources that have not been preset.

In one development, furthermore, the at least one target variable is set on the basis of the n luminous sources by means of at least one of the following parameters:

- luminous flux;
- illuminance;
- light intensity;
- luminance.

In the context of an additional development the three luminous sources that have not been preset span a triangle in a CIE x-y diagram, the triangle having a largest possible area, in particular.

A next development consists in the fact that the n luminous sources cover a broad luminous spectrum.

In one configuration the n luminous sources or some of the n luminous sources have only small to no overlaps in the respective spectra thereof.

Consequently, it is advantageously possible for some of the luminous sources in each case to supply their own contribution to the overall spectrum, said contribution otherwise not being supplied by at least some of the remaining luminous sources.

The object mentioned above is also achieved by means of an arrangement for setting a color locus comprising a processor unit or a computer, which is set up in such a way that the method described herein can be carried out thereby.

Furthermore, the object mentioned above is achieved by means of an arrangement for setting a color locus including

- at least one luminous source;
- at least one temperature sensor;
- a unit for setting the at least one luminous source depending on a temperature determined by the temperature sensor for the purpose of attaining the color locus.

One development consists in the fact that a temperature of the at least one luminous source is determinable on the basis of the temperature sensor, and/or that a temperature of a luminous module is determinable on the basis of the temperature sensor, the at least one luminous source being thermally coupled to the luminous module.

Consequently, the temperature of the at least one luminous source can be determinable in particular indirectly on the basis of the at least one temperature sensor. By way of example, the temperature of the at least one luminous source can be deduced by way of the measured temperature of the luminous module; in particular, a plurality of temperatures of a plurality of luminous sources can be determinable in this way. LEDs having different wavelengths can preferably be used as luminous sources.

In another development, a plurality of temperature sensors are provided, which are arranged at different locations of the luminous module comprising the at least one luminous source.

An additional development consists in the fact that more than three luminous sources are provided, a first group including three luminous sources and a second group including the remaining luminous sources. The unit for setting the at least one luminous source sets the first group of luminous sources in such a way that the desired color locus is attainable.

In one configuration, moreover, on the basis of the unit for setting the at least one luminous source, a temperature of the at least one luminous source is determinable and a brightness and a wavelength of the at least one luminous source are determinable depending on the temperature of the at least one luminous source.

Moreover, for achieving the object, a luminous system is specified, including an arrangement as described herein.

Furthermore, the luminous system can be embodied as a luminous module, a lamp, a luminaire or as a spotlight.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
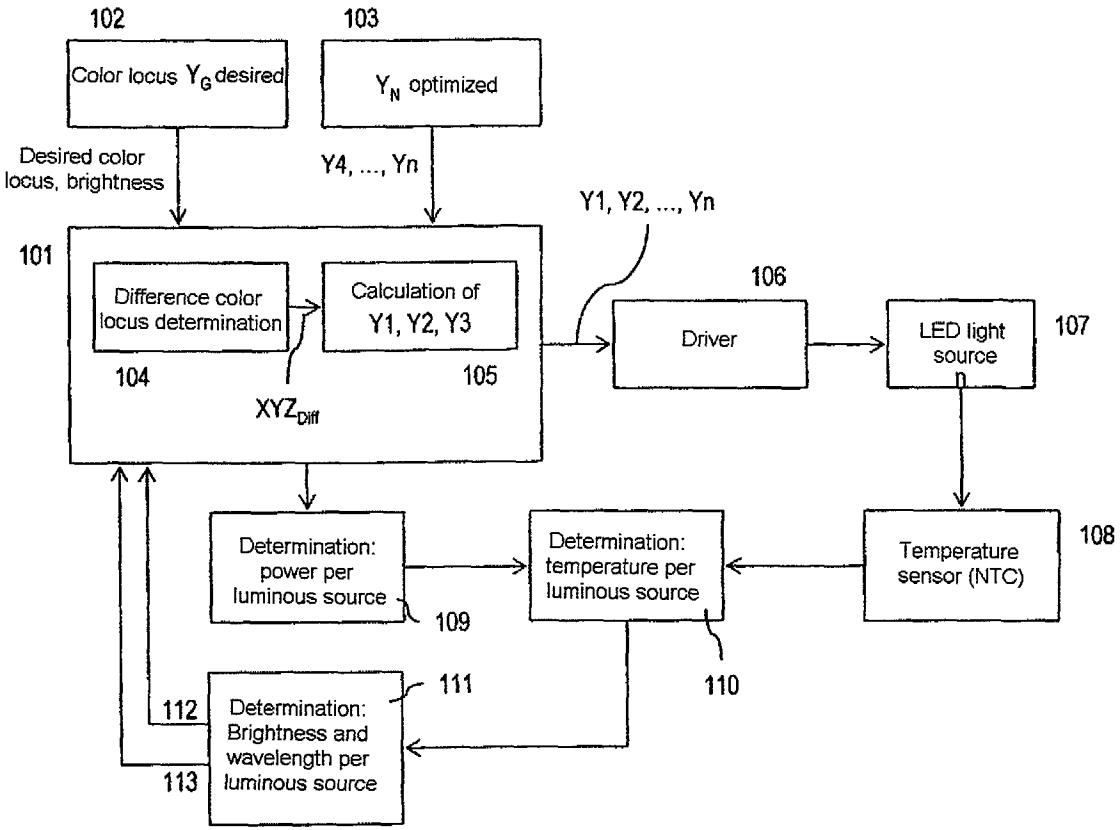
FIG. 1 shows a schematic diagram comprising a color management system for regulating and/or setting a desired color locus on the basis of measured temperatures of a luminous module and/or at least one luminous source.

The following detailed description refers to the accompanying drawings that show, by way of illustration, specific details and embodiments in which the invention may be practiced.

The approach presented here enables particularly efficient compensation of temperature effects of a luminous module comprising a plurality of luminous sources, in particular LEDs, wherein a color locus stabilization of the luminous sources can be effected on the basis of a temperature to be determined. Consequently, expensive and complex optical sensors for ascertaining the present color locus of the luminous sources and/or of the luminous module can advantageously be obviated.

The color locus of a luminous source, in particular of an LED, can vary depending on the wavelength, in which case, particularly in the case of the LED, the wavelength changes with the junction temperature of the LED. In addition, a luminous flux decreases as the temperature rises. Color locus and luminous flux exhibit a highly nonlinear behavior, in particular, over a temperature profile. Settable light sources (LEDs) that are stable in respect of color locus compensate for such dependencies.

In accordance with the solution proposed here, LEDs can be described mathematically, such that, with knowledge of the junction temperature of the respective LED, a present color locus and the emitted luminous flux and/or the luminous intensity can be determined. Accordingly, the color locus and luminous flux of the LED can advantageously be deduced on the basis of the temperature of the LED. Accordingly, given knowledge of the temperature for the respective LED it is possible to carry out a corresponding compensation of, in particular, the color locus of the luminous module comprising a plurality of LEDs. Consequently, an expensive optical sensor can advantageously be obviated.

Depending on the technology and/or construction of an LED, differently pronounced thermal effects arise during the operation of the LED.

Thus, a dominant wavelength of the LED is shifted in the direction of higher wavelengths as the temperature increases and/or a luminous flux decreases as the temperature increases.

In order to determine the respective temperature curve, a large number of measurement data are preferably evaluated for each LED type.

In order to calculate the present (temperature-dependent) color locus of the individual LED, the respective dominant wavelength and saturation (purity) are advantageously taken as a basis. Said saturation is independent of temperature and is can be assumed to be constant.

On the basis of the preceding evaluations, in particular, it is possible to create polynomials which, for each LED type, describe a relationship between the dominant wavelength and the color coordinates cx and respectively cy (the third coordinate cz results from the equation $cx+cy+cz=1$).

Proceeding from the dominant wavelength at a reference temperature of e.g. 25° C. (this dominant wavelength may be known from a calibration, for example) and also from a present junction temperature estimated by means of a power and a sensor during operation, it is possible, by means of the temperature characteristic curves normalized to the one 25° C. value, to calculate the present dominant wavelength and to determine the color locus of the individual LED.

The luminous flux can also be determined on the basis of the temperature characteristic curves normalized to the 25° C. value.

In order to determine the temperature, in particular the junction temperature of the LED, at least one temperature sensor can be provided, which is thermally coupled to the LED. In particular, different thermal sensors can be provided, including in combination with one another. It is also possible for a plurality of temperature sensors to be arranged at different position of a luminous module. Through knowledge of the positions in relation to the LED (or correspondingly to a plurality of LEDs of a luminous module), it is correspondingly possible to determine a temperature distribution between the LEDs or temperature gradients along a luminous module. The junction temperature of the LED can thereby be determined with higher accuracy.

Examples of a temperature sensor include: NTC thermistor (NTC), PTC thermistor (PTC), temperature detector, thermoelement, pyrometer, or the like.

Given a known current impressed on the LED and given known forward voltage characteristic curves of the LED and given known thermal resistances and efficiencies, it is possible to determine the junction temperature of the LED.

Consequently, the junction temperatures of a plurality (any desired number) of LEDs can be deduced depending on a temperature measured on a luminous module. Accordingly, the abovementioned variables appertaining to lighting technology of wavelength (color locus) and luminous intensity (brightness), are determinable for each LED and hence for the luminous module overall.

Optionally, for an (each) LED it is possible to store an ageing curve in the luminous flux calculation. Consequently, a natural ageing of the LED (or of the plurality of luminous sources or LEDs of the luminous module) can be taken into account and compensated for during the regulation of the color locus.

Consequently, the approach described here makes it possible to ensure a color locus stability of LED luminous modules or LED luminaires without optical feedback, in particular without employing or using expensive optical sensors.

In particular, a calibration or regulation by means of a plurality of temperatures can be omitted. Instead, during the regulation, the present color locus of the luminous sources is determined and correspondingly set to a desired color locus (if necessary). Complexity and costs for LED luminaires can therefore be effectively reduced with this approach.

The approach presented here allows, in particular, a setting and also a continuous and/or iterative regulation of a color locus by means of a color management system, more than 3 light emitting diodes having different wavelengths preferably being used.

The exemplary embodiment explained below relates to a luminous system or luminous module comprising n luminous sources, e.g. n LEDs, each of which has, in particular, a different wavelength.

As an alternative, it is also possible to use fewer than 3 luminous sources.

When 3 luminous sources are used, the possibility arises (provided that the 3 luminous sources are chosen in such a way that they span a corresponding color space) that each color locus can be set by means of predefinable driving of the 3 luminous sources. Accordingly, the desired color locus can be tracked in the case of an alteration (e.g. as a result of thermal effects) of the color locus on the basis of the 3 luminous sources. In this case, it is necessary to detect a deviation from the desired color locus.

It should expressly be noted that the present approach is not restricted to one of the cases "fewer than 3 luminous sources", "exactly 3 luminous sources" or "more than 3 luminous sources".

The following exemplary embodiment is based, by way of example, on more than 3 luminous sources, in particular on 5 LEDs as light means.

It is assumed, by way of example, that a luminous system has n luminous sources, which are preferably configured as LEDs.

Firstly, the n luminous sources can be determined on the basis of at least one of the following parameters:

luminous flux;

illuminance;

light intensity;

luminance.

In this case, it is possible to set a relation of the abovementioned parameters for the n luminous sources in such a way that at least one of the following predefinable target variables color rendering index (CRI);

color quality scale (CQS);

an application-dependent spectral distribution is attained as well as possible.

A suitable optimization can be used for this purpose.

By way of example, it is possible to select or predefine the n luminous sources in such a way that they have a spectral distribution that is correspondingly favorable and perceived as pleasant for an observer in the case of a luminous system. This can be achieved by using luminous sources which in each case constitute a complementary contribution in the luminous spectrum of the luminous system relative to the other luminous sources. By way of example, if one luminous source, e.g. an LED, has a very limited spectral extent within the desired spectrum of the luminous system, then further LEDs can be provided, the spectra of which lie complementarily in a different frequency range. The overall spectrum thus results from the superimposition of the spectra of the individual luminous sources.

In particular, a (substantially) white luminous source having a correspondingly broad spectrum can be provided.

Consequently, what can be achieved in the setting of the color locus of the luminous system is that, on account of the correspondingly optimized spectrum, the luminous system reproduces the set or preselected color in a manner that is uniform and pleasant for the observer.

Preferably, n−3 specific parameters are predefined as color valences Y4 . . . Yn.

On the basis of the predefined n−3 luminous sources each having specific color valences, it is possible to determine a color locus difference, e.g. a difference in color locus, from the desired color locus to be set. For this purpose, there is the possibility, in particular, for a desired color locus and also a brightness of the luminous system to be set by a user, for example.

In order to determine the difference in color locus, a desired color valence Y-total is preferably set to 100% or to the value to be attained by the system (brightness predefinition of the user).

The 3 luminous sources with their predefined colors are then available for attaining a setting to the desired color locus. For this purpose, these 3 luminous sources should be predefined, in particular, in such a way that they span a largest possible area (e.g. a largest possible triangle) in a CIE x-y diagram.

The parameters for setting the 3 luminous sources can be determined as follows:

$$\begin{pmatrix} X_{Diff} \\ Y_{Diff} \\ Z_{Diff} \end{pmatrix} = \begin{pmatrix} \frac{x_1}{y_1} & \frac{x_2}{y_2} & \frac{x_3}{y_3} \\ 1 & 1 & 1 \\ \frac{z_1}{y_1} & \frac{z_2}{y_2} & \frac{z_3}{y_3} \end{pmatrix} \cdot \begin{pmatrix} Y_1 \\ Y_2 \\ Y_3 \end{pmatrix}$$

This equation enables the colorimetric calculation of the variables or parameters $Y_1$, $Y_2$ and $Y_3$ appertaining to lighting technology that are to be set for the purpose of setting the difference color locus or for the purpose of attaining the desired color locus.

In this case, it should be noted that each of the 3 luminous sources can also include more than one light means or more than one LED. By way of example, a plurality of LEDs having a substantially identical color valence can be combined to form a luminous source. Correspondingly, a plurality of LEDs having different color valences can also be combined to form a luminous source in accordance with the present description.

On the basis of the measured at least one controlled and/or regulated variable of the luminous system, it is possible to determine color valences of the individual colors of the luminous sources and also a necessary shift (x, y) for attaining the desired color locus.

Furthermore, a regulation can be effected iteratively, continuously and/or at specific points in time in such a way that a control unit (color management system) determines anew the color valences Y to be set (on the basis of renewed measurement of the at least one controlled and/or regulated variable of the luminous system) and thus reacts for example to changes that occur in the junction temperatures of the LEDs by readjustment to or stabilization of the desired color locus.

For the case where a luminous source includes a regulable white light source, the case can occur that, in order to attain the desired color locus, the individual colors are not required separately in a manner dependent on the desired color locus. A joint utilization of a control channel is thus possible.

In the case of use of more than 3 luminous sources (each luminous source can in this case include at least one light emitting diode, in particular), the 3 luminous sources advantageously having different colors and spanning a largest possible color space, the approach described here allows the fact that a freely predefined color locus within the color space can be stabilized by means of a regulation of three colors and a spectrum optimized to one or more target variables is determinable.

Moreover, an optimization of the spectrum with regard to specific target variables can be determined beforehand once, in particular. Such an optimization can be complex and time-intensive for example, and can therefore advantageously not be effected on the luminous module itself. The optimization serves as input for the regulation (color management system), for attaining or setting the desired color locus on the basis of the freely settable luminous sources. The solution of the equation system for setting the desired color locus by means of three luminous sources can be carried out rapidly and efficiently on the luminous module.

FIG. 1 shows one possibility for regulating and/or setting a desired color locus by means of a color management system 101.

In this case, a total intensity of a desired color locus comprising a desired color locus having an associated brightness serves as an input variable 102. An optimized intensity of the colors of the n luminous sources in accordance with a driving curve as shown in FIG. 5 constitutes a further input variable 103 for the color management system 101.

Figure 5:
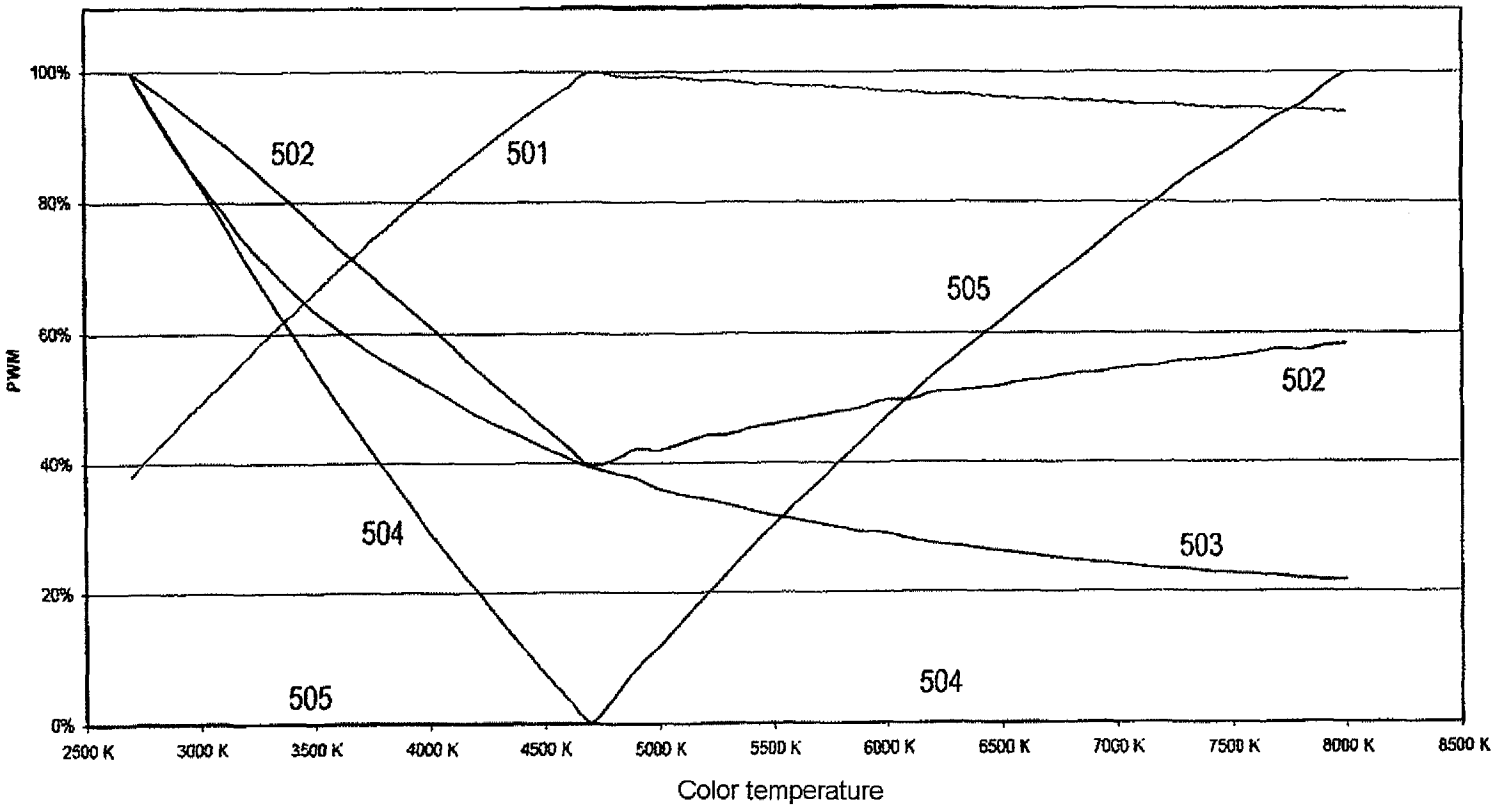
FIG. 5 shows driving curves for attaining an optimized color rendering of the luminous system including a plurality (5) of luminous sources.

Proceeding from n luminous sources, by way of example, the intensities of the luminous sources 4 to n, on the basis of the driving curves in accordance with FIG. 5, are determined by the color management system 101 on the basis of an optimization—determined beforehand—according to at least one target variable. This predefinition is used for setting the remaining luminous sources 1 to 3 in order to attain the desired color locus.

The color management system 101 includes a unit 104 for difference color locus determination and a unit 105 for calculation of the intensities of the individual colors Y1, Y2 and Y3. Consequently, the color management system 101 provides as output signal the intensities Y1 to Yn of the luminous sources 1 to n, which are used by a driver 106 for setting the luminous sources, here the LED light sources 107.

At least one temperature sensor 108 is used in order to determine the temperature of the LED light sources 107. Preferably, at least one NTC thermistor NTC is used for this purpose. As an alternative, other temperature sensors (see explanations above) can be used. Combinations of identical or of different temperature sensors (e.g. at different locations on the luminous module) can also be used.

The temperature sensor 108 supplies as output signal a temperature $T_{NTC}$ to a unit 110 for the determination of the temperature $T_j$ per luminous source j (j=1 . . . n) or per LED.

A unit 109 determines an electrical power required or consumed by the luminous module comprising the luminous sources $$P_{CHIP}(\eta,PWM,U,I)$$

depending on the following variables:

η efficiency,

PWM pulse width modulation (corresponds to the luminous intensity or brightness), U voltage, I current.

The unit 109 supplies as an output signal a power per luminous source. If, therefore, for example 5 different-colored light emitting diodes are provided (see example in accordance with FIG. 4 or FIG. 5), then a dedicated electrical power is determined for each of the 5 light emitting diodes on the basis of the unit 109 and is provided to a unit 110.

The unit 110 receives the electrical powers $P_{CHIP}$ of the individual luminous sources or LEDs from the unit 109 and the currently measured temperature $T_{NTC}$ from the temperature sensor 108. The unit 110 enables a determination of the temperature $T_j$ per luminous source j (j=1 . . . n) in accordance with the following specification:

$$T_j(P_{CHIP},T_{NTC},R_{TH})$$

where $R_{TH}$ denotes a thermal resistance of the arrangement. If there are 5 different LEDs, for example, then the unit 110 provides five temperature values $T_1$ to $T_5$, one per LED.

These temperature values $T_j$ per luminous source j are forwarded to a unit 111 for the determination of the brightness and the wavelength per luminous source. This unit 111 determines, on the basis of the temperature values $T_j$ for each LED j, the associated brightnesses $\phi(T_j)$ 113 and wavelengths $\lambda(T_j)$ or the coordinates or color loci $(x,y)_j$ 112 associated with the wavelengths in a color space.

These values 112 and 113 are fed to the color management system 101, which, by means of its unit 104 for difference color locus determination (for the signal 112) and also by means of its unit 105 for calculation of the brightnesses (for the signal 113), ascertains a deviation from a desired color locus and instigates a corresponding regulation or tracking of the settable luminous sources 1 to 3.

Figure 2:
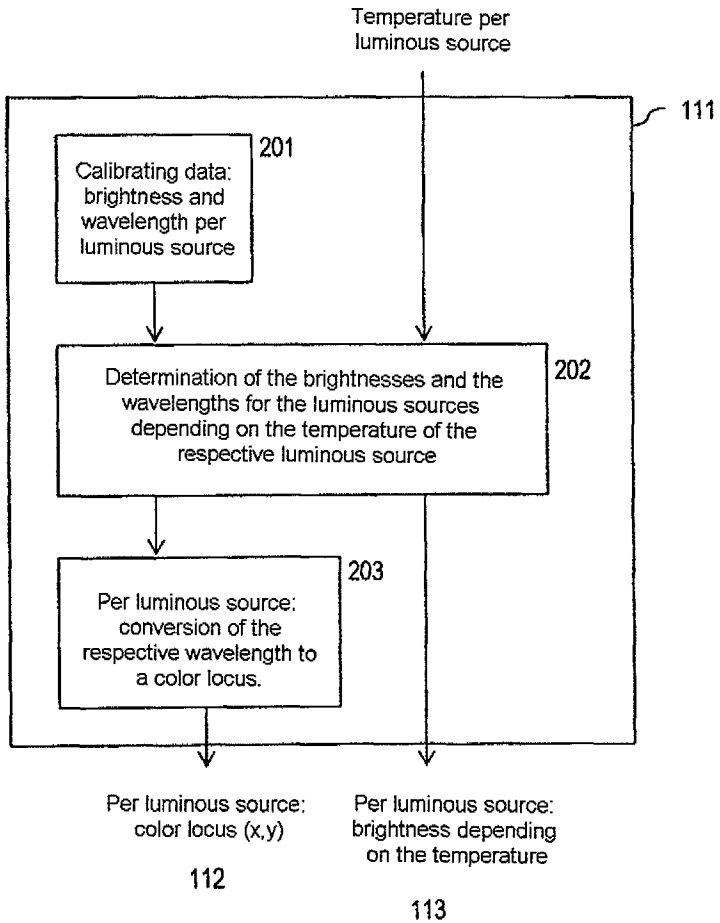
FIG. 2 shows a detail schematic diagram of the unit for determining the brightness and wavelength per luminous source on the basis of the temperatures of the individual luminous sources.

A detailed illustration of the unit 111 is shown in FIG. 2. From the unit 110, the unit 111 receives the temperatures $T_j$ per luminous source, which are fed to a unit 202 for the determination of brightnesses and wavelengths for the luminous sources on the basis of the temperature $T_j$ and further calibration data, which are provided by a unit 201. The determination of the brightnesses $\Phi(T_j)$ and the wavelengths $\lambda_{DOM}$ (T) for the respective luminous sources j is effected in accordance with the following mappings:

$$\phi(T_j,\phi_{25^\circ C.})$$

$$\lambda_{DOM}(T_j,\lambda_{DOM_25^\circ C.})$$

depending on the following variables:

$\phi_{25^\circ C.}$ Comparison value for the brightness of the real LED at 25° C.;

$\lambda_{DOM_25^\circ C.}$ Comparison value for the dominant wavelength of the real LED at 25° C.

The values $\phi$(25° C.) and respectively $\lambda_{DOM}$(25° C.) are communicated for each of the luminous sources or LEDs from the unit 201 to the unit 202.

The unit 202 makes the brightnesses $\phi(T_j)$, per luminous source or LED j available as a signal 113 to the color management system 101.

Furthermore, a unit 203 is provided, which, on the basis of the wavelengths $\lambda_{DOM}(T_j)$ per luminous source j that are supplied by the unit 202, performs a conversion into coordinates of the color space in accordance with the following mapping:

$$cx(\lambda_{DOM})\text{and}$$

$$cy(\lambda_{DOM})$$

where cx and cy denote the color loci (x,y) coordinates in the color space. These coordinates are provided per luminous source j as a signal 112 to the color management system 101.

The functional units described in connection with FIG. 1 and FIG. 2, in particular the units 109 to 111 and the units 201 to 203, are shown and described as separate functional blocks for the sake of clarity. However, it is possible to implement all functions or a portion thereof in one or more integrated circuits. Moreover, individual functional units from among those shown separately can be combined or individual units can be divided into further subunits. In principle, the degree of subdivision of the functionally concrete units as described here should in no way be understood to be restrictive with regard to the actual implementation in hardware and/or software.

FIG. 5 illustrates drive curves for attaining an optimized (and advantageously determined beforehand), color rendering of the luminous system.

The color temperature in kelvins is indicated along the abscissa and the brightness of the respective luminous source, to be set by pulse width modulation PWM, in percent is indicated along the ordinate.

Driving curves for 5 light emitting diodes are shown by way of example in FIG. 5. A driving curve 501 shows the profile for a white LED, a driving curve 502 shows the profile for a green LED, a driving curve 503 shows the profile for a red LED, a driving curve 504 shows the profile for a yellow LED, the driving curve 504 having a brightness of approximately 0% starting from approximately 4700K, and a driving curve 505 shows the profile for a blue LED, the driving curve 505 having a brightness of approximately 0% up to approximately 4700K.

Channel switching from the yellow LED to the blue LED is possible starting from 4700K.

The profile of the driving curves 501 to 505 can be determined for example by means of a simulation of the luminous system.

Figure 3:
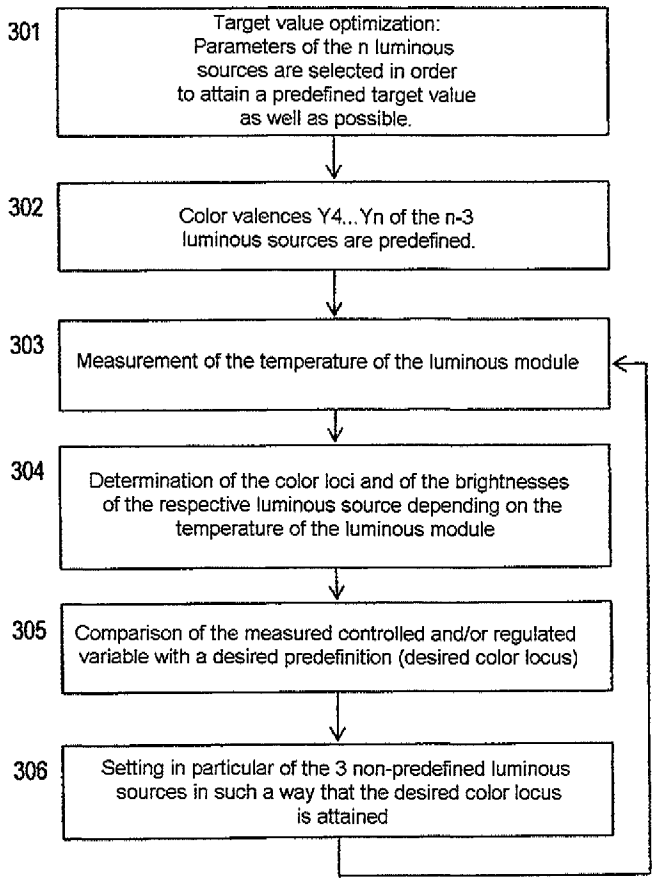
FIG. 3 shows a flow chart for a method for setting a color locus.

FIG. 3 shows a flow chart for a method for setting a colour locus.

In a step 301, a target value optimization is advantageously effected depending on the respective luminous system in such a way that parameters of the n luminous sources are selected or determined in such a way that a predefined target value is attained as well as possible. By way of example, at least one of the following variables can serve as parameters: luminous flux; illuminance; light intensity; and/or luminance. By way of example, at least one of the following target variables can be used for the target value optimization: color rendering index; color quality scale; and/or an application-dependent spectral distribution.

In a step 302, color valences Y4 to Yn of the n−3 luminous sources are predefined on the basis of the target value optimization.

In a step 303, the temperature of the luminous module is measured on the basis of at least one temperature sensor and, in a step 304, brightnesses and color loci of the luminous sources, in particular LEDs provided in the luminous module are determined depending on the measured temperature.

In a step 305, a comparison between the measured controlled and/or regulated variable and a desired predefinition, in particular a desired color value, is carried out. The deviation determined is thereby overcome and the desired color value is set by means of the 3 non-predefined luminous sources being set (step 306). Optionally, after step 306, the method can branch to step 303 and an iterative regulation and/or setting of the desired color locus can thus be attained.

The approach presented here can be carried out, in particular, in a luminous system, e.g. a luminous unit or luminous module including a processor unit or a computer or a regulating unit for determining and setting the desired color locus. In this case, the luminous system can include a plurality of luminous sources, each of which has, in particular, at least one LED.

The luminous system or luminous module described can be used, in particular, in a spotlight and/or in a lamp or luminaire. The brightness and/or the hue can preferably be predefined by the user within certain limits. Thus, by way of example, a hue from bluish through to reddish light can be made possible, in which case the lamp, on the basis of the approach presented here, maintains the respectively selected hue and the associated brightness.

Figure 4:
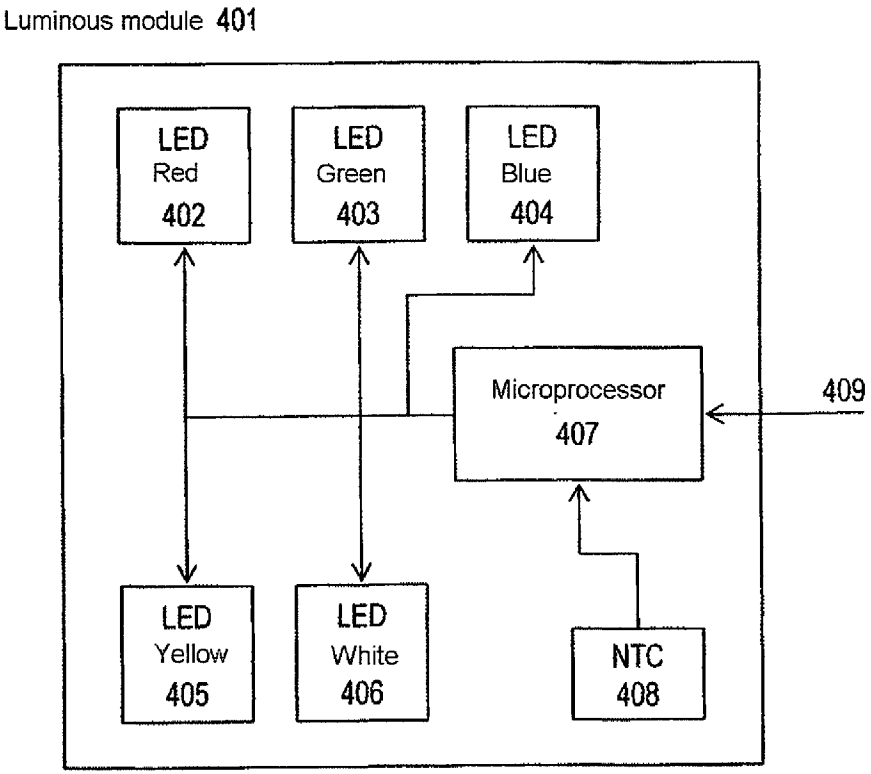
FIG. 4 shows a functional schematic diagram of components of a luminous module with a temperature sensor.

FIG. 4 shows by way of example a luminous module 401 including a microprocessor 407, which can generally be embodied as a computer, a regulating unit, a programmed and/or programmable logic unit. Accordingly, the microprocessor 407 can have memories, input/output interfaces and calculation possibilities for access to and for processing of current data or data determined in advance and stored.

Furthermore, a temperature sensor 408 is provided, which can be embodied as an NTC thermistor NTC. The temperature sensor 408 supplies measured values of the luminous module to the microprocessor 407.

Furthermore, the luminous module 401 comprises five light emitting diodes 402 to 406 in the colors red, green, blue, yellow and white.

The method described herein, in particular, is executable on the microprocessor 407, that is to say that the microprocessor 407 determines, depending on the current temperature of the luminous module as provided by the temperature sensor 408, the temperatures of the LEDs 402 to 406 and, on the basis of these temperatures, their respective emitted wavelength and brightness. On the basis thereof, the microprocessor 407 determines a deviation from a desired value (the predefinition of a desired color locus—e.g. color locus and brightness of the luminous unit—can be effected by a user on the basis of an input possibility 409) and sets the LEDs 402 to 406 in such a way that said desired color locus is obtained (as well as possible).

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for setting a color locus of at least one luminous source, the method comprising:

determining a temperature;

setting the color locus of the at least one luminous source depending on the temperature determined;

wherein the temperature is determined of at least one of the:

at least one luminous source, and a luminous module upon which the at least one light source is arranged;

wherein a brightness and a wavelength of the at least one luminous source are determined on the basis of the temperature of at least one of the:

at least one luminous source, and the luminous module;

wherein the brightness and the wavelength are determined depending on ageing information concerning the at least one luminous source.

2. The method as claimed in claim 1, wherein the brightness and the wavelength are determined depending on predefined calibration data.

3. The method as claimed in claim 1, wherein the ageing information is an ageing characteristic curve of the luminous source.

4. The method as claimed in claim 1, wherein a plurality of luminous sources are provided in such a way that the plurality of luminous sources or some of the plurality of luminous sources have only small to no overlaps in the respective spectra thereof.

5. The method as claimed in claim 1, wherein the brightness and the wavelength of the at least one luminous source are converted into an actual color locus.

6. The method as claimed in claim 5, wherein the actual color locus is compared with the color locus and the at least one luminous source is set in such a way that the color locus is attained.

7. The method as claimed in claim 1, wherein the temperature is determined on the basis of at least one temperature sensor.

8. The method as claimed in claim 7, wherein a plurality of temperature sensors are provided at different locations.

9. The method as claimed in claim 7, wherein the temperature is furthermore determined on the basis of at least one of an emitted power and on the basis of a thermal resistance.

10. The method as claimed in claim 7, wherein the temperature is determined on the basis of at least one of an NTC thermistor and a PTC thermistor.

11. An arrangement for setting a color locus, the arrangement comprising:

at least one luminous source;

at least one temperature sensor;

a device configured to set the at least one luminous source depending on a temperature determined by the temperature sensor for the purpose of attaining the desired color locus;

wherein the temperature is determined of at least one of the:

at least one luminous source, and a luminous module upon which the at least one light source is arranged:

wherein a brightness and a wavelength of the at least one luminous source are determined on the basis of the temperature of at least one of the:

at least one luminous source, and the luminous module;

wherein the brightness and the wavelength are determined depending on ageing information concerning the at least one luminous source.

12. The arrangement as claimed in claim 11, wherein a temperature of the at least one luminous source is determinable on the basis of the temperature sensor, the at least one luminous source being thermally coupled to the luminous module.

13. The arrangement as claimed in claim 11, wherein a temperature of a luminous module is determinable on the basis of the temperature sensor, the at least one luminous source being thermally coupled to the luminous module.

14. A method for setting a color locus of at least one luminous source, the method comprising:

determining a temperature;

setting the color locus of the at least one luminous source depending on the temperature determined;

wherein the temperature of the at least one luminous source is determined by:

electrical power consumed by a luminous source, and a thermal resistance.

* * * * *